United States Patent [19]

Bailey et al.

[11] Patent Number: 5,022,472

[45] Date of Patent: Jun. 11, 1991

[54] HYDRAULIC CLAMP FOR ROTARY DRILLING HEAD

[75] Inventors: Thomas F. Bailey; John E. Campbell, both of Houston, Tex.

[73] Assignee: MASX Energy Services Group, Inc., Houston, Tex.

[21] Appl. No.: 436,523

[22] Filed: Nov. 14, 1989

[51] Int. Cl.[5] ..... E21B 33/03

[52] U.S. Cl. ..... 175/195; 166/84; 285/920

[58] Field of Search ..... 285/316, 920; 175/195, 175/210; 166/82, 84; 277/31

[56] References Cited

U.S. PATENT DOCUMENTS

| | | | |
|---|---|---|---|
| 1,097,508 | 5/1914 | Bailey | 285/362 |
| 1,895,132 | 1/1933 | Minor | 285/145 |
| 1,909,304 | 5/1933 | Mueller | 166/86 |
| 1,910,634 | 5/1933 | Pearce | 285/144 |
| 2,155,837 | 4/1939 | Penick et al. | 285/144 |
| 2,233,041 | 2/1941 | Alley | 285/145 |
| 2,327,980 | 8/1943 | Bryant | 74/625 |
| 2,692,066 | 10/1954 | Conrad | 285/145 |
| 2,846,247 | 8/1957 | Davis . | |
| 3,017,931 | 1/1962 | Jackson, Jr. et al. | 285/144 |
| 3,090,640 | 5/1963 | Otteman | 285/144 |
| 3,100,015 | 8/1963 | Regan | 166/86 |
| 3,137,348 | 6/1964 | Ahlstone et al. | 285/144 |
| 3,239,248 | 3/1966 | Jones | 285/145 |
| 3,334,923 | 8/1967 | Putch | 285/145 |
| 3,334,924 | 8/1967 | Todd | 285/145 |
| 3,338,596 | 8/1967 | Knox | 285/141 X |
| 3,400,938 | 9/1968 | Williams | 277/31 |
| 3,438,653 | 4/1969 | Fowler | 285/141 |
| 3,472,535 | 10/1969 | Kinley | 285/145 |
| 3,488,031 | 1/1970 | Bezner et al. | 285/141 |
| 3,561,527 | 2/1971 | Nelson | 166/86 |
| 3,598,429 | 6/1971 | Arnold | 285/18 |
| 3,784,234 | 1/1974 | Mohr | 285/18 |
| 4,043,389 | 8/1977 | Cobb | 166/55 |
| 4,285,406 | 8/1981 | Garrett et al. | 175/195 |
| 4,304,310 | 12/1981 | Garrett | 175/195 |
| 4,411,434 | 10/1983 | Lewis | 277/27 |
| 4,416,340 | 11/1983 | Bailey | 175/195 |
| 4,423,776 | 1/1984 | Wagoner et al. | 166/84 |
| 4,461,354 | 7/1984 | Buras et al. | 166/343 |
| 4,480,703 | 11/1984 | Garrett | 175/195 |
| 4,506,863 | 3/1985 | Quin et al. | 285/920 X |
| 4,561,499 | 12/1985 | Berner, Jr. et al. | 166/85 |
| 4,615,546 | 10/1986 | Nash et al. | 285/316 X |
| 4,632,432 | 12/1986 | Reneau | 285/920 X |
| 4,650,225 | 3/1987 | Le et al. | 285/348 |
| 4,667,986 | 5/1987 | Johnson et al. | 285/920 X |
| 4,708,376 | 11/1987 | Jennings et al. | 285/920 X |
| 4,715,625 | 12/1987 | Shows, Jr. et al. | 285/145 |
| 4,754,820 | 7/1988 | Watts et al. | 175/195 |
| 4,770,250 | 9/1988 | Bridges | 166/382 |
| 4,783,084 | 11/1988 | Biffle | 173/195 X |

*Primary Examiner*—William P. Neuder

*Attorney, Agent, or Firm*—Edgar A. Zarins; Malcolm L. Sutherland

[57] ABSTRACT

A rotary drilling head having an upper body incorporating a kelly bushing removably clamped onto a stationary spool. The clamp assembly is hydraulically controlled to permit remote operation and access to the drive bearings and stripper rubbers within the drilling head. Secondary manual means for unclamping the assembly are also provided. The hydraulic clamp includes an annular piston movably disposed within a cylinder and acting upon bearing members to lock and unlock the clamp assembly. Hydraulic pressure is utilized to move the piston within the cylinder. A spring biases the piston towards the locked position to prevent inadvertent unclamping.

22 Claims, 4 Drawing Sheets

HYDRAULIC CLAMP FOR ROTARY DRILLING HEAD

BACKGROUND OF THE INVENTION

I. Field of the Invention

This invention relates to rotary drilling heads incorporating a kelly drive and stripper rubbers for developing a well and, in particular, to a hydraulically actuated clamp assembly of the drilling head which can be remotely operated to permit access to the interior components of the drilling head.

II. Description of the Prior Art

A rotary drilling head is typically attached to the top of a well casing to facilitate drilling operations while providing safety features and drilling mud diversion. The drilling apparatus generally comprises a rotatable drill stem used to rotate a drill bit within the well. The drill stem may include a string of drill pipes connected to a non-circular pipe, commonly referred to as a kelly, slidably extending through the rotary table. The kelly transmits the drive from the rotary table to the drilling head via the kelly bushings. In the usual forward circulation drilling operation, a drilling fluid may be forced through the interior of the hollow drill stem and drill bit of the bottom of the hole. Cuttings and debris at the bottom of the well are carried upwardly in the annulus between the outside of the drill string and the well bore. The drilling head includes a stationary outer housing or spool which is secured to the top of the casing, a drive ring and bearing assembly, and a drive assembly in cooperation with the drive ring and bearing assembly. The drive assembly includes a kelly bushing. A rubber stripper is attached for rotation with the drive ring in slidable sealing engagement with the kelly drive.

In operation, the split kelly bushing is slidably connected to the kelly drive. As the kelly drive is lowered through the drilling head the kelly bushing is received within the drive assembly. Rotation of the kelly causes the kelly bushing to rotate which rotates the drive assembly which in turn rotates the drive ring and attached rubber stripper. The rubber stripper diverts the drilling mud through a side port of the drilling head while maintaining sealing engagement with the kelly.

Various arrangements have been provided for removing worn drilling head components from within the spool. Early drilling heads incorporated an expandable/contractible split clamp to secure the upper assembly of the drilling head to the spool. Such clamps utilize a plurality of pivoting segment which together may be moved radially outward or inward. Typically, such clamps are manually operated and therefore required a workman to go under the rig floor, a precarious position. Hydraulically operated clamps were later developed, however, these clamp assemblies tend to accumulate mud and debris obstructing radial movement. Other clamp configurations also have proven unsatisfactory in allowing remote unclamping of the drilling head for access to the interior components.

SUMMARY OF THE PRESENT INVENTION

The present invention overcomes the disadvantages of the prior known rotary drilling heads by providing a hydraulic clamp which can be remotely operated in order to provide access to the interior components of the drilling head.

The rotary drilling head of the present invention generally comprises a main spool housing which retains the stripper rubber in sealing contact with the kelly to divert drilling mud through a side port of the drilling head. The housing also retains a drive ring and bearing assembly which is interlocked with a kelly drive bushing to which the stripper rubber is attached. The drive bushing is adapted to rotate with the kelly The selectively engageable clamp assembly of the present invention is utilized to interlock the drive bushing with the drive ring to prevent longitudinal movement of the drive bushing as the kelly and drill string are run into or out of the well hole. However, as the kelly is rotated, the drive ring, drive bushing and stripper rubber will rotate along with them to maintain sealing engagement to divert the drilling fluids and prevent a blowout of the well head.

The clamp assembly which positionally maintains the drive bushing within the drive ring is hydraulically operated using inlet and outlet hydraulic lines. The hydraulic ports communicate with a cylinder within which is slidably positioned a piston member. The interior wall of the cylinder is formed by the rotatable drive ring while the outer wall is formed by a stationary cylinder body within which the hydraulic ports are formed. The drive ring includes a plurality of apertures adapted to receive a lock ball which is in contact with the piston. With the drive bushing positioned within the drive ring, the lock ball will be seated within an annular groove in the bushing to prevent axial displacement of the bushing. The piston includes a cammed surface such that in a first position the piston will force the lock ball radially inwardly into the groove of the bushing and in a second position the lock ball will be free to move out of the groove allowing removal of the drive bushing from within the drive ring. A plurality of radially spaced springs biases the piston towards the locking position to prevent inadvertent unclamping in the case of a hydraulic failure.

Other objects, features, and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
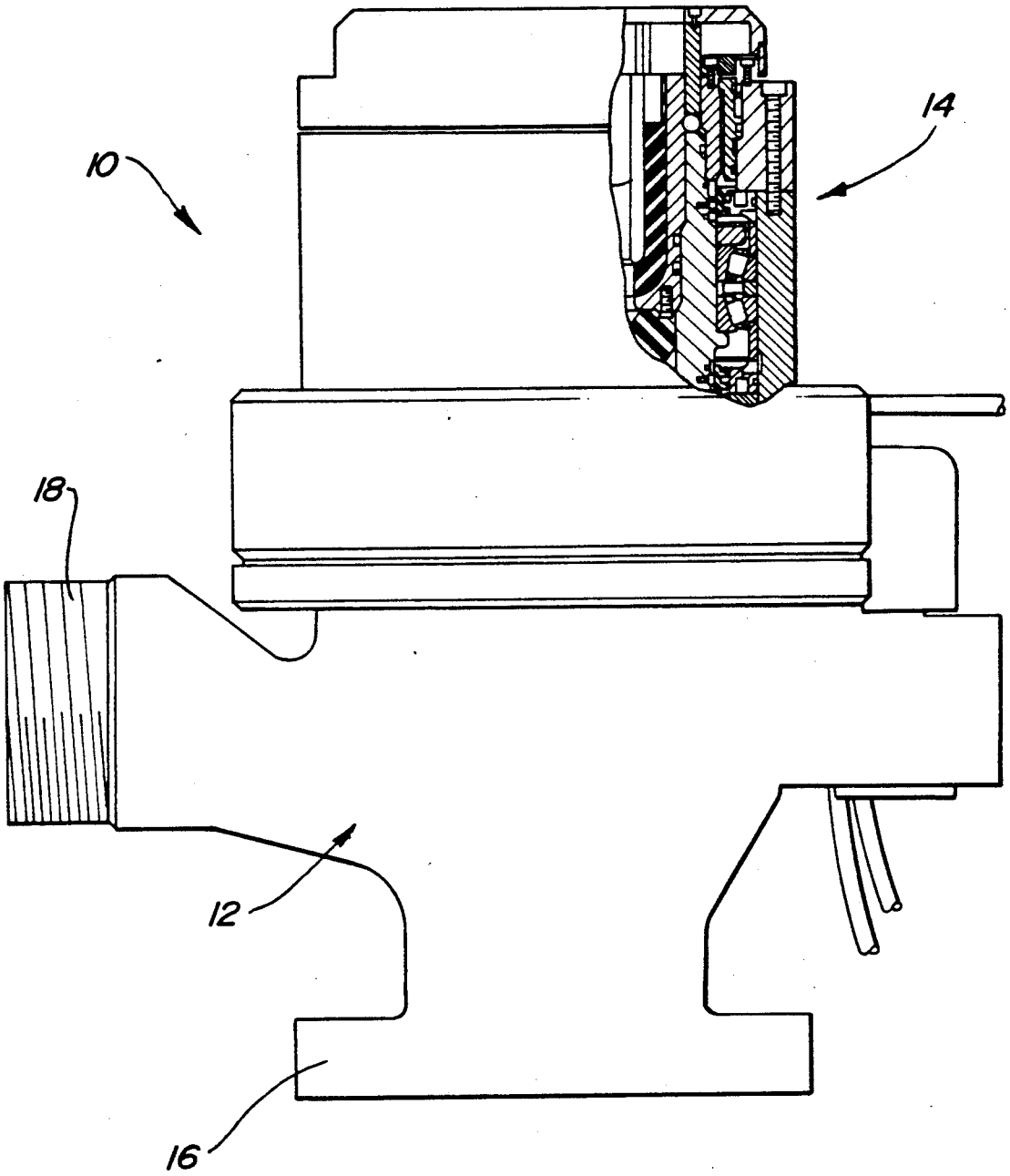
FIG. 1 is a perspective view of a rotary drilling head embodying the present invention.

Referring first to FIG. 1, there is shown a rotary drilling head 10 embodying the present invention generally comprising a spool body 12 and an upper drive assembly 14 mounted to the spool body 12. The drilling head 10 is normally positioned below a rotary table and above the BOP. The rotary table includes a rotatable, non-circular kelly drive member which extends through the drilling head 10. Multiple sections of drill string may be attached to the kelly for rotation therewith with the kelly connected to the uppermost section.

The spool body 12 is provided with a connecting flange 16 for securing the drilling head 10 to a mating flange of the upper end of a well casing or blowout preventer. A secondary outlet 18 is formed in the spool body 12 to divert drilling fluid from the well bore away from the rig floor. As will be subsequently described in detail, drilling fluid from the well is prevented form flowing up into the drilling head 10 by a stripper rubber which sealingly engages the kelly drive member thereby diverting the drilling fluid through the outlet 18.

Referring now to FIGS. 2 through 5, the drive assembly 14 is mounted at the upper end of the spool body 12 using a plurality of mounting bolts 20 through outer body wall 22. The drive assembly 14 generally includes a drive ring 24 position for rotation within the spool body 12, a bearing assembly 26 disposed between the drive ring 24 and, in a preferred embodiment, the spool body 12 to facilitate rotation of the drive ring 24, a drive bushing 28 adapted to receive the kelly drive member, and a stripper rubber 30 attached to the lower end of the drive bushing 28 for rotation therewith as the kelly rotates. A slinger seal 32 is attached to the top of the drive ring 24 to cap the drive assembly 14. The kelly drive bushing 28 and stripper rubber 30 are axially removable from within the drive ring 24 through the top of the drilling head 10 in order to service the drive assembly 14 or replace the stripper rubber 30. A clamp assembly 34 embodying the present invention maintains the drive bushing 28 within the drive assembly 14 as will be subsequently described.

In a preferred embodiment, the bearing assembly 26 is positioned between the wall of the spool 12 and the rotatable drive ring 24. The bearing assembly 26 is sealed at both ends by an upper seal 36 and a lower seal 38 to contain the bearing lubricant which can be supplied through lubricant passageways 40 and 42. The bearing assembly 26 includes inner bearing races 44 and outer bearing races 46 between which are disposed roller bearings 48. Spacer rings 50 and 52 maintain separation of the races 44 and 46 respectively. The rollers 48 and races 44 and 46 are prevented from longitudinally shifting within the lubricant chamber by shoulder 54 formed on the drive ring 24 and lock ring 56 secured to the drive ring 24 at the upper end of the bearing assembly 26. As a result of its position, the bearing assembly 26 limits both longitudinal and radial movement of the drive ring 24.

The drive ring 24 extends substantially the height of the drive assembly 14 and forms an axial passageway to receive the drive bushing 28 and the kelly drive member. The drive ring 24 includes an inner shoulder 58 which forms a seat for the drive bushing 28. An outer shoulder 60 forms a seat for the clamp assembly 34. The drive ring 24 may also be provided with lubricant passageways 62 to facilitate lubrication of the bearing assembly 26.

The kelly drive bushing 28 is matingly received within the drive ring for rotation therewith as the kelly drive member rotates. The drive bushing 28 has a non-circular axial passageway 64 which corresponds to the configuration of the kelly drive member. A preferred embodiment of the drive bushing 18 includes an outer bushing member 66, and inner bushing member 68 and an elastomeric member 70 sandwiched therebetween to absorb the shock vibrations transmitted through the kelly drive during drilling operations. The outer member 66 includes an annular shoulder 72 adapted to seatingly cooperate with the shoulder 58 of the drive ring 24. An O-ring seal 74 and a packing seal 76 in the outer bushing member 66 sealingly cooperate with the drive ring 24 to prevent fluid flow between the drive ring 24 and drive bushing 28. The stripper rubber 30 is detachably secured to the lower end of the outer bushing member 66 by a series of bolts 78 which allows the stripper 30 to be replaced as it becomes worn and loses its sealing properties. The upper end of the drive bushing 28 includes a tongue and groove arrangement to ensure that rotation of the bushing 28 is transmitted to the drive ring 24. In a preferred embodiment, the drive bushing 28 includes a plurality of spaced apart splines 80 at its upper end which are received in corresponding longitudinal grooves 82 formed in the upper end of the drive ring 24. Thus, the kelly drive bushing 28 will seat within the drive ring 24 as a result of the cooperating shoulders 58 and 72 and rotation of the bushing 28 will be transmitted to the drive ring 24 by the splines 80. However, only the clamp assembly 34 prevents the bushing 28 and stripper 30 from being withdrawn from the drive ring 24.

Figure 4:
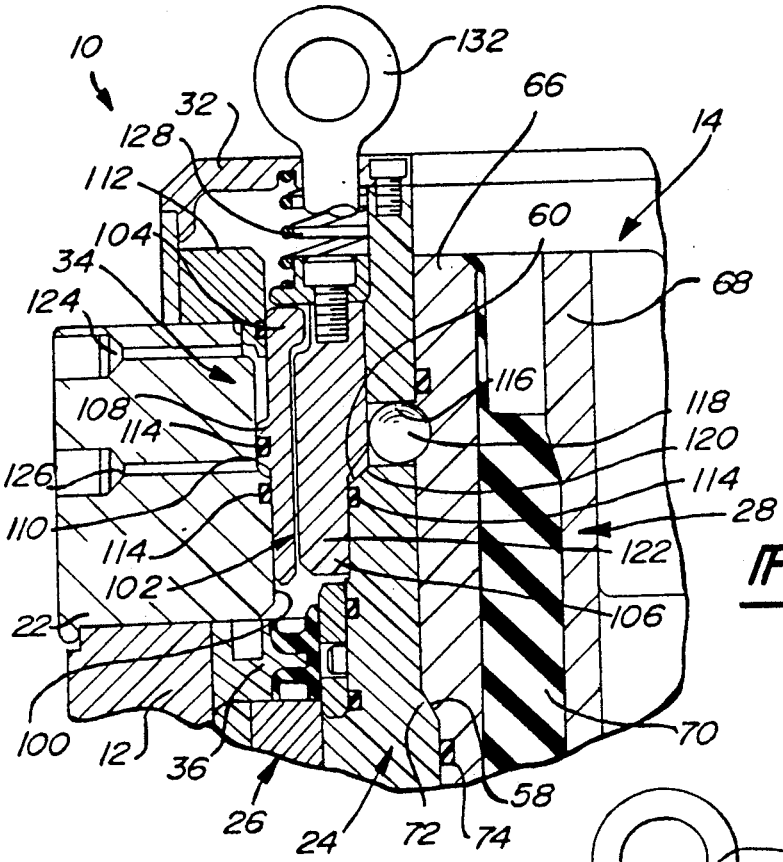
FIG. 4 is an enlarged cross-sectional perspective of the clamp assembly in the locked position.
Figure 5:
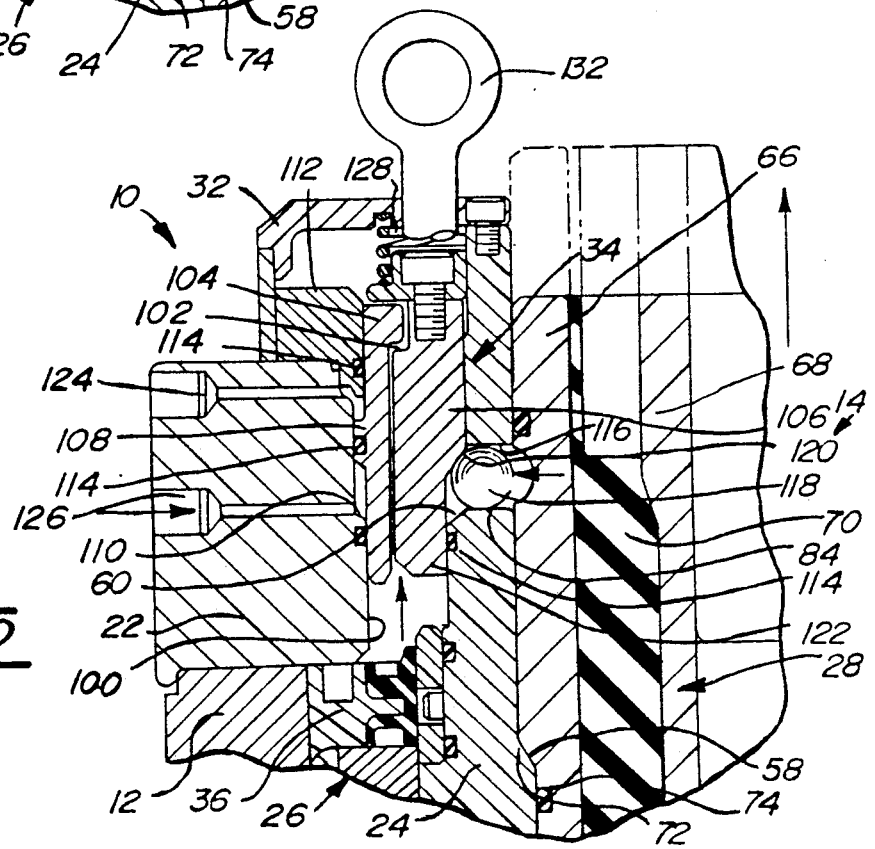
FIG. 5 is an enlarged cross-sectional perspective of the clamp assembly in the unlocked position.

Referring now to FIGS. 4 and 5, the clamp assembly 34 allows selective removal of the drive bushing 28 from the drilling head 10. The clamp assembly 34 may be remotely operated through the supply of hydraulic fluid thereby eliminating the need for a worker to manually release the drive bushing 28 from the spool body 12 to service the drilling head 10. The clamp assembly 34 preferably includes an annular cylinder 100 having slidably disposed therein an annular piston 102. The piston 102 is made up of an outer piston member 104 and an inner piston member 106 for ease of assembly. The outer piston member 104 includes a flange 108 which limits the travel of the piston 102 within the cylinder 100. A shoulder 110 formed in the outer body wall 22, which forms the outer wall of the cylinder 100, cooperates with the flange 108 to limit the downward travel of the piston 102. A cylinder cap 112 secured to the outer body wall 22 cooperates with the flange 108 to limit the upward travel of the piston 102 within the cylinder 100. The piston 102 and the cylinder 100 are provided with numerous seals 114 to facilitate hydraulic displacement of the piston 102 within the cylinder 100.

The drive ring 24 forms the inner wall of the cylinder 100 and includes a series of spaced apart apertures 116 which receive locking balls 118. The locking balls 118 are in cooperating engagement with the piston 102 but the apertures 116 are sealed off from the hydraulic pressure within the cylinder 100 by the seals 114. The piston 102 includes a camming surface 120 thereby creating a smaller width portion 122 of the piston 102 which allows the locking balls 118 to recede from the apertures 116 while the camming surface 120 and the upper larger width portion of the piston 102 force the locking balls 118 radially inwardly into an annular groove 84 formed on the outer surface of the drive bushing 28 as will be subsequently described.

Movement of the piston 102 within the cylinder 100 is controlled by hydraulic fluid pressure supplied to the cylinder 100 at opposite ends of the piston 102. Hydraulic fluid supply passageways are formed in the outer body wall 22 and include a first fluid port 126 communicating with the lower portion of the cylinder 100 to move the piston 102 upwardly towards an unlocked position (FIG. 5). In addition, to bias the piston 102 downwardly towards the locked position such that the clamp 34 will become unlocked only when hydraulic pressure is supplied to move the piston 102, the drilling head 10 includes a plurality of radially spaced springs 128 biased against the upper end of the piston 102. One end of the spring 128 is seated within the slinger seal 32 while attached to the opposite end of the spring 128 is a spring push plate 130 which bears against the top of the piston 102. Just as the springs 128 prevent inadvertent unlocking of the clamp 34, particularly in the event of a hydraulic pressure loss, manual override means are provided for moving the piston 102 to the unlocked position in case the hydraulics fail. A pair of eye hooks 132 are attached to the piston 102 to permit the piston to be moved to the unlocked position in the event of a hydraulic failure. Thus, the clamp assembly 34 of the present invention permits remote unclamping through hydraulic fluid supply as well as secondary systems for maintaining the clamp 34 in the locked position or unclamping the assembly 34.

Figure 2:
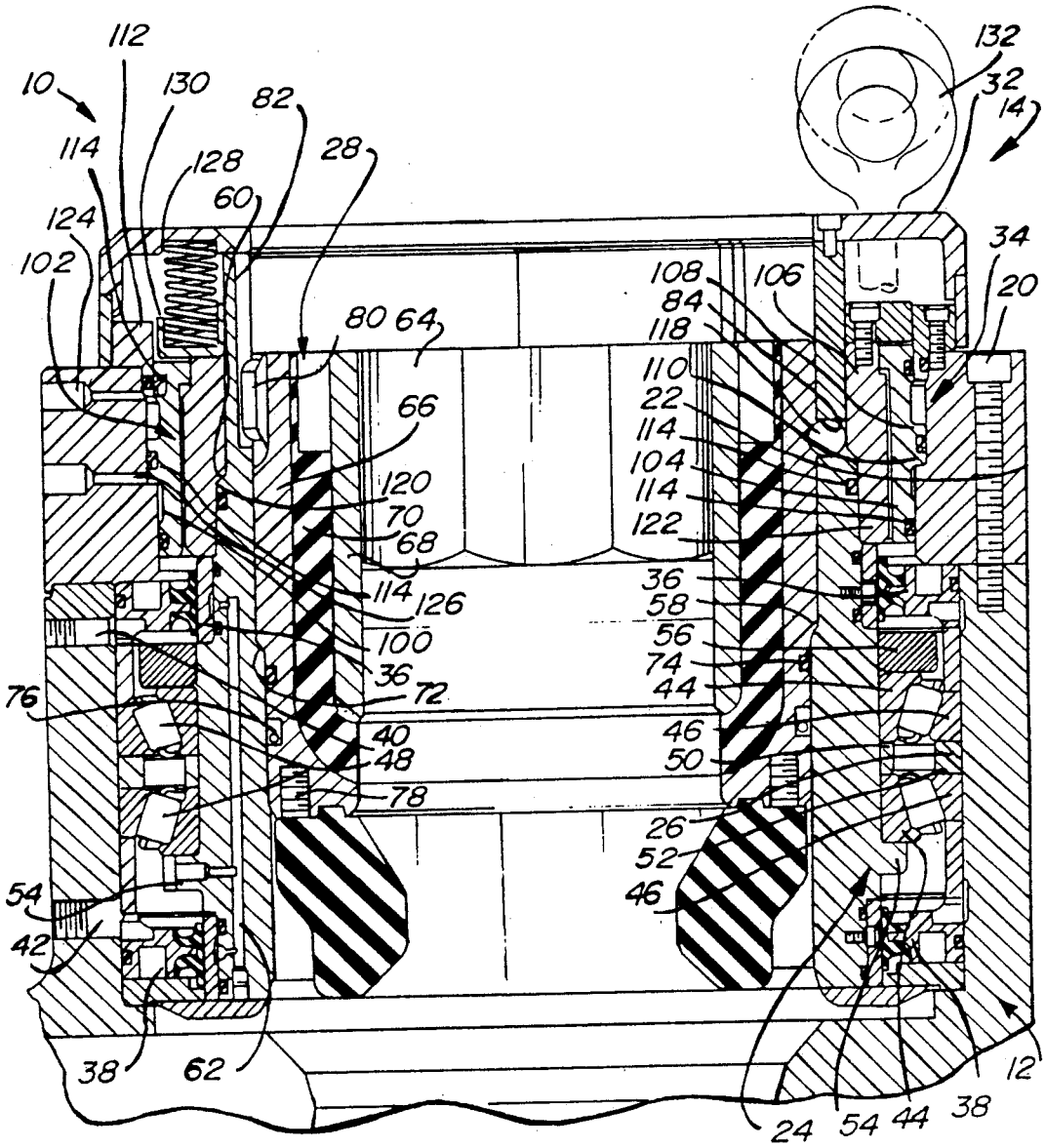
FIG. 2 is a cross-sectional view of a drilling head incorporating the hydraulic clamp assembly embodying the present invention shown in the locked position.
Figure 3:
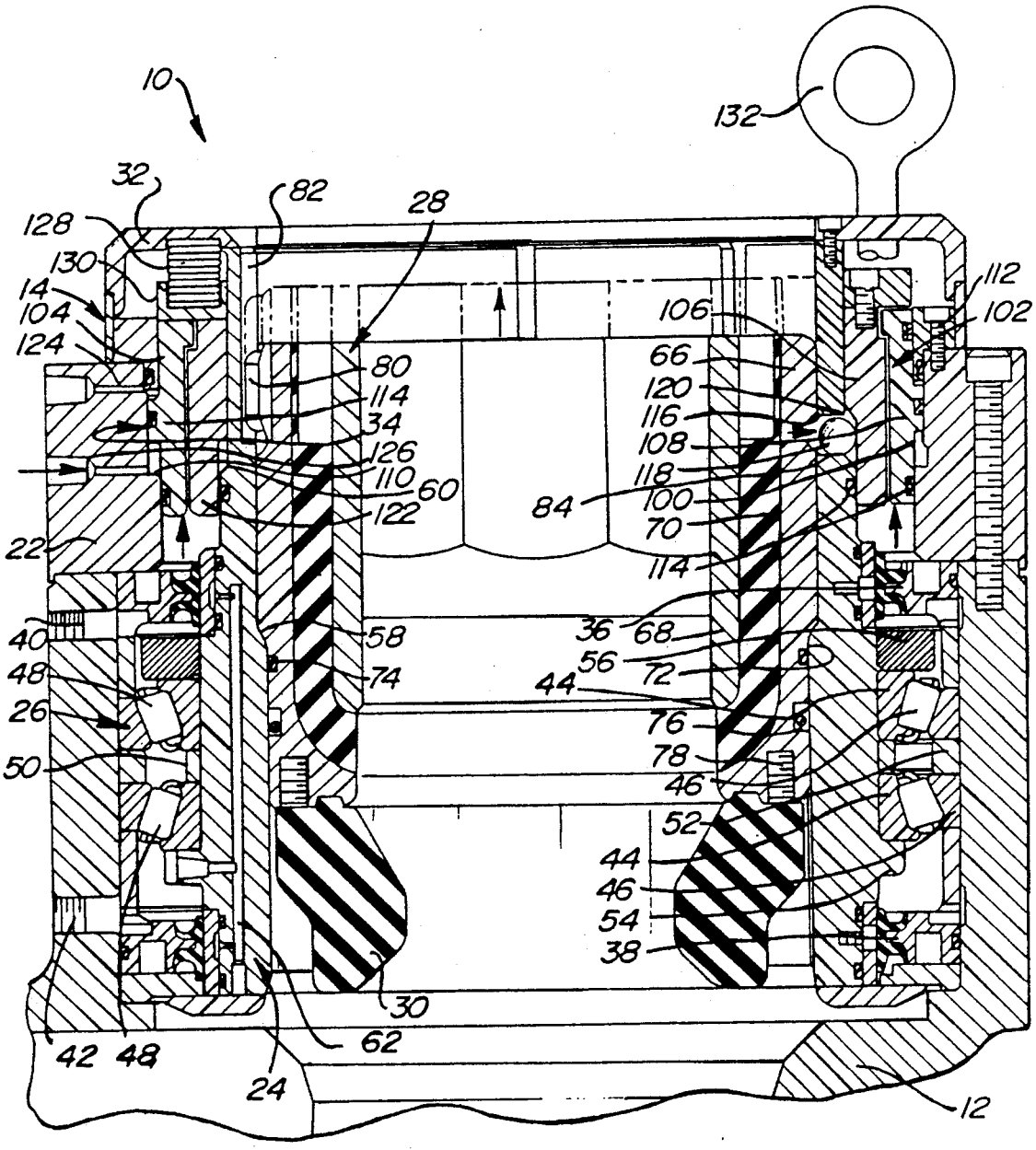
FIG. 3 is a cross-sectional view of the drilling head with the clamp assembly in the unlocked position.

During drilling operations as the drill string and kelly are run in and out of the well bore, components of the drilling head 10 may become worn requiring access to the internal structure. Particularly susceptible to wear and requiring frequent replacement is the stripper rubber 30 secured to the bottom end of the kelly drive bushing 28. The clamp assembly 34 of the present invention locks the drive bushing 28 against axial displacement within the drive ring 24. Initially the drive assembly 14 is assembled with the bushing 28 seated within the drive ring 24. The locking balls 118 will extend into the groove 84 of the drive bushing 28 as the piston 102 is in its locked position (FIGS. 2 and 4). The piston 102 will be maintained in the locked position by the hydraulic pressure supplied through port 124 and the springs 128. When it is determined that the stripper rubber 30 should be replaced, hydraulic fluid pressure is increased through port 126 as it is decreased through port 124 causing the piston 102 to move upwardly against the force of the springs 128. As the camming surface 120 moves past the locking balls 118 they will be free to withdraw from the groove 84 and apertures 116. The drive bushing 28 and stripper 30 can now be removed from the drilling head 10. Once repositioned, hydraulic pressure through port 126 is decreased and hydraulic pressure through port 124 is increased causing the piston 102 to move downwardly towards the locked position. The camming surface 120 will force the locking balls 118 radially inwardly into the groove 84 once again clamping the kelly drive bushing 28 within the drive ring 24 and the drilling head 10.

The foregoing detailed description has been given for clearness of understanding only and no unnecessary limitations should be understood therefrom as some modifications will be obvious to those skilled in the art without departing from the scope and spirit of the appended claims:

We claim:

1. A rotary drilling head comprising:

a spool body; and an upper drive assembly mounted to said spool body, said drive assembly including drive means adapted for rotation within said spool body, a bearing assembly disposed between said drive means and said spool body, a drive bushing matingly received within said drive means and adapted to receive a kelly drive member and hydraulically operated clamp means for selectively locking said drive bushing against axial displacement within said drive means, said clamp means being remotely controlled to selectively clamp said drive bushing within said drive means;

said clamp means including an annular cylinder formed in said upper drive assembly and a hydraulically displaced piston ring slidably received within said annular cylinder, said piston selectively cooperating with at least one locking ball retractably engageable with said drive bushing to prevent axial displacement of said drive bushing within said upper drive assembly, said piston slidably displaceable between an unlocked position and a locked position.

2. The drilling head as defined in claim 1 wherein said drive bushing includes an elastomeric stripper detachably secured to the lower end of said bushing such that upon unclamping said drive bushing from said drive means, said drive bushing and stripper may be removed from said spool body.

3. The drilling head as defined in claim 1 wherein said drive means includes an annular drive ring received in said spool body.

4. The drilling head as defined in claim 3 wherein said cylinder has an annular configuration extending about the outer periphery of said drive bushing, an inner wall of said cylinder formed by said drive ring an an outer wall of said cylinder formed by an outer body of said drive assembly.

5. The drilling head as defined in claim 4 wherein said drive ring includes at least one aperture to receive said at least one locking ball, said at least one locking ball selectively engaging an annular groove formed in said bushing to prevent axial displacement of said drive bushing within said drive ring.

6. The drilling head as defined in claim 5 wherein said piston includes a camming surface engageable with said at least one locking ball to radially displace said at least one locking ball between an unlocked position withdrawn from said groove of said drive bushing and a locked position seated within said groove to prevent axial displacement of said drive bushing.

7. The drilling head as defined in claim 6 wherein said outer body wall of said drive assembly includes at least two hydraulic ports providing fluid communication between said cylinder and the exterior of said drilling head for remote hydraulic control of said clamp means by displacing said piston within said cylinder.

8. The drilling head as defined in claim 1 and further comprising means for biasing said piston towards said locked position to prevent inadvertent unclamping of said clamp means in the event of a hydraulic failure.

9. The drilling head as defined in claim 8 wherein said biasing means comprises at least one spring engaging an upper end of said piston to bias said piston downwardly towards said locked position.

10. The drilling head as defined in claim 8 and further comprising override means connected to said piston for manually moving said piston to said unlocked position in the event of a hydraulic failure.

11. A rotary drilling head comprising:

a spool body mounted to an upper end of a well casing, said spool body having an outlet port for diverting drilling fluid through said drilling head;

an upper drive assembly mounted to said spool body, said drive assembly including a kelly drive means rotatable within said spool body, a bearing assembly disposed between said drive means and said spool body, a kelly drive bushing removably received within said drive means and adapted to receive a kelly drive member, and a elastomeric stripper detachably secured to the lower end of said bushing; and clamp means for selectively locking said drive bushing against axial displacement within said drive means while allowing said drive means to rotate within said spool body, said clamp means being hydraulically remotely controlled to selectively move said clamp means between a locked position and an unlocked position wherein said drive bushing and stripper may be removed from said upper drive assembly;

said clamp means including an annular cylinder formed in said upper drive assembly, a hydraulically controlled piston ring slidably received within said annular cylinder, and at least one locking ball in selective engagement by said piston, said at least one locking ball retractably engageable with said drive bushing to prevent axial displacement of said drive bushing within said upper drive assembly.

12. The drilling head as defined in claim 11 wherein said drive means comprises a drive ring, said drive ring having at least one aperture corresponding to and receiving said at least one locking ball and said drive bushing having an annular groove to selectively receive said at least one locking ball preventing axial displacement of said drive bushing within said drive ring.

13. The drilling head as defined in claim 12 wherein said piston includes a camming surface selectively engageable with said at least one locking ball to radially displace said locking ball as said piston moves between an unlocked and a locked position.

14. The drilling head as defined in claim 13 wherein said cylinder includes a pair of hydraulic ports, hydraulic fluid being supplied through a first port to said cylinder to displace said piston to said locked position and hydraulic fluid being supplied through a second port to said cylinder to displace said piston to said unlocked position.

15. The drilling head as defined in claim 14 and further comprising means for biasing said piston towards said locked position to prevent inadvertent unclamping of said clamp means.

16. The drilling head as defined in claim 14 and further comprising override means connected to said piston for manually moving said piston to said unlocked position.

17. The drilling head as defined in claim 13 wherein said clamp means includes a plurality of locking balls radially spaced along said annular cylinder, said locking balls lockingly engaging said drive bushing at spaced apart positions along the outer periphery of said bushing.

18. A rotary drilling head comprising:

a spool body mounted to an upper end of a well casing, said spool body having an outlet port for diverting drilling fluid through said drilling head;

an upper drive assembly mounted within said spool body, said drive assembly including kelly drive means rotatable within said spool body, a bearing assembly disposed between said drive means and said spool body, a kelly drive bushing removably received within said drive means and adapted to receive a kelly drive member;

clamp means for selectively locking said drive bushing against axial displacement within said drive means, said clamp means being hydraulically remotely controlled to selectively move said clamp means between a locked position and an unlocked position wherein said drive bushing and stripper may be removed from said drive assembly;

said clamp means including an annular cylinder formed in said upper drive assembly, a hydraulically controlled piston slidably received within said cylinder concentric with said drive bushing and at least one locking ball in selective engagement by said piston, said at least one locking ball retractably engageable with said drive bushing upon moving said piston to a locked position to prevent axial displacement of said drive bushing within said upper drive assembly.

19. The drilling head as defined in claim 18 wherein said drive means comprises a drive ring, said drive ring having at least one aperture corresponding to and receiving said at least one locking ball and said drive bushing having an annular groove to selectively receive said at least one locking ball preventing axial displacement of said drive bushing within said drive ring.

20. The drilling head as defined in claim 19 wherein said piston includes a camming surface selectively engageable with said at least one locking ball to radially displace said locking ball as said piston moves between an unlocked and a locked position.

21. The drilling head as defined in claim 20 wherein said annular cylinder includes a pair of hydraulic ports, hydraulic fluid being supplied through a first port to said cylinder to displace said piston to said locked position and hydraulic fluid being supplied through a second port to said cylinder to displace said piston to said unlocked position.

22. The drilling head as defined in claim 21 and further comprising spring means for biasing said piston towards said locked position to prevent inadvertent unclamping of said clamp means.

* * * * *